US007185511B2

(12) United States Patent
Ryan et al.

(10) Patent No.: US 7,185,511 B2
(45) Date of Patent: Mar. 6, 2007

(54) COMPOSITION AND APPARATUS FOR TRANSFERRING HEAT TO OR FROM FLUIDS

(75) Inventors: Thomas Anthony Ryan, Cheshire (GB); Harry Sharrock, Wigan (GB)

(73) Assignee: Chemviron Carbon Limited, Grays (GB)

( * ) Notice: Subject to any disclaimer, the term of this patent is extended or adjusted under 35 U.S.C. 154(b) by 166 days.

(21) Appl. No.: 10/381,230

(22) PCT Filed: Sep. 21, 2001

(86) PCT No.: PCT/GB01/04222

§ 371 (c)(1),
(2), (4) Date: Aug. 21, 2003

(87) PCT Pub. No.: WO02/25190

PCT Pub. Date: Mar. 28, 2002

(65) Prior Publication Data

US 2004/0025533 A1 Feb. 12, 2004

(30) Foreign Application Priority Data

Sep. 23, 2000 (GB) ..... 0023380.9

(51) Int. Cl.
*F25B 17/08* (2006.01)
*F25D 3/10* (2006.01)
*C09K 5/00* (2006.01)

(52) U.S. Cl. ..... 62/480; 62/294; 62/259.3; 252/69

(58) Field of Classification Search ..... 62/480, 62/294, 259.3, 112, 86; 252/67–69
See application file for complete search history.

(56) References Cited

U.S. PATENT DOCUMENTS 4,147,808 A * 4/1979 Liepa et al. ..... 426/477
4,214,011 A * 7/1980 Strube ..... 426/591

(Continued)

FOREIGN PATENT DOCUMENTS

EP 0 661 049 A2 7/1995

(Continued)

OTHER PUBLICATIONS

International Search Report dated Dec. 13, 2001 of corresponding PCT application No. PCT/GB01/04222.

*Primary Examiner*—Chen-Wen Jiang
(74) *Attorney, Agent, or Firm*—Cohen & Grigsby, P.C.

(57) ABSTRACT

A composition for effecting heat transfer to or from a fluid, the composition comprising a primary adsorbent material, such as activated carbon, for adsorption of a gas, such as carbon dioxide, and a graphite material in an amount of 0.01 to 80% by weight of the total composition. A binder may also be included in the composition to aid heat transfer. The composition may be incorporated into an apparatus (12) that includes sealing means (14) for retaining the gas on the surface of the material and a release mechanism (16) for breakage of the seal, said apparatus being provided with a vessel (6) for holding fluid.

45 Claims, 3 Drawing Sheets

U.S. PATENT DOCUMENTS

Figure 1:
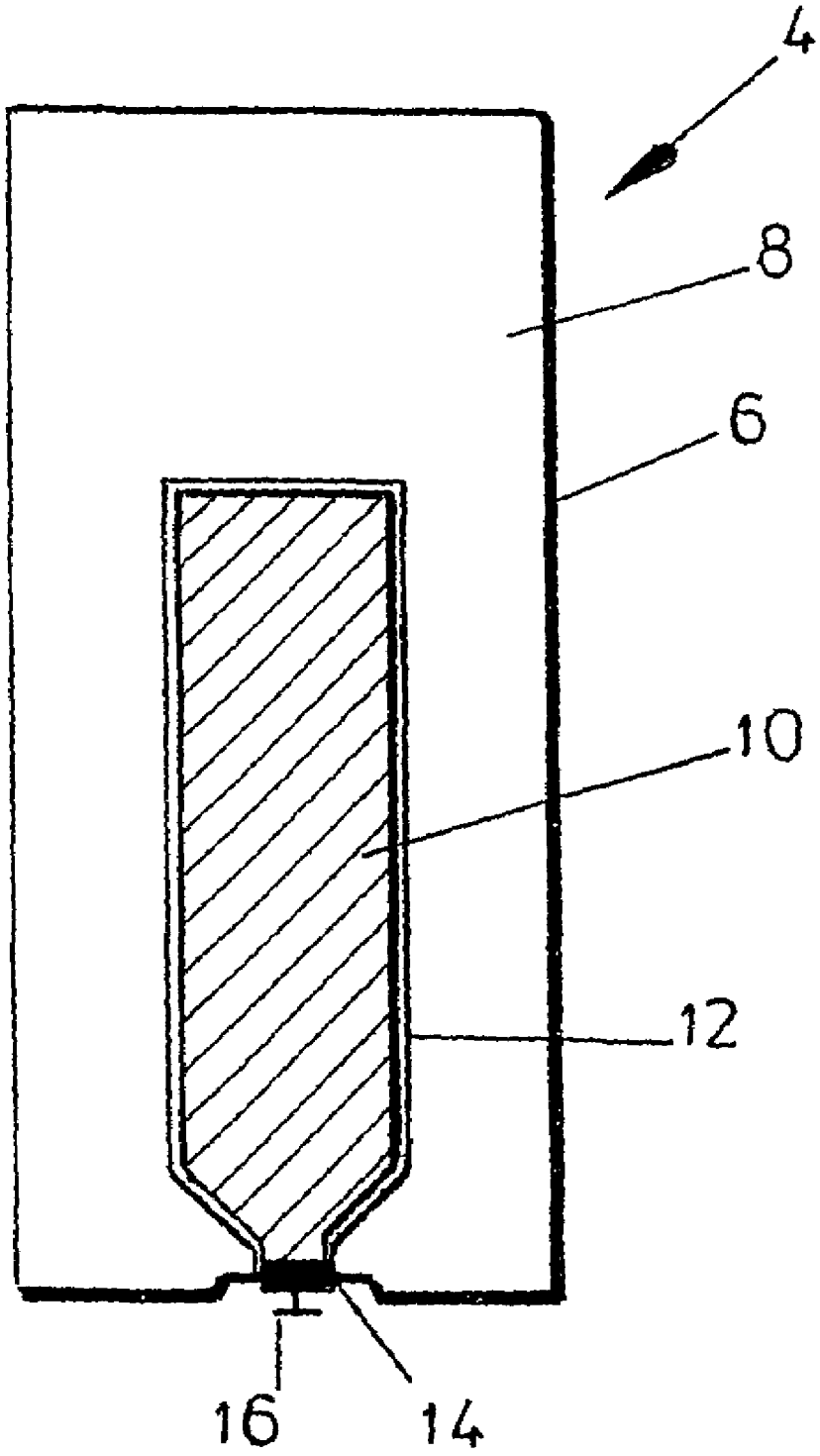

| | | | | | |
|---|---|---|---|---|---|
| 4,999,330 | A | | 3/1991 | Bose et al. | 502/402 |
| 5,393,442 | A | * | 2/1995 | Buchwald et al. | 508/341 |
| 5,440,899 | A | * | 8/1995 | De Beijer et al. | 62/480 |
| 5,482,906 | A | * | 1/1996 | Sakai et al. | 502/402 |
| 5,692,381 | A | * | 12/1997 | Garrett | 62/60 |
| 5,842,350 | A | | 12/1998 | Spinner et al. | 62/86 |
| 5,875,648 | A | * | 3/1999 | Boye et al. | 62/480 |
| 5,931,005 | A | | 8/1999 | Garrett et al. | 62/86 |
| 6,105,384 | A | | 8/2000 | Joseph | 62/293 |
| 6,155,073 | A | * | 12/2000 | Gray | 62/480 |

FOREIGN PATENT DOCUMENTS

| | | | | |
|---|---|---|---|---|
| EP | 0 752 565 | A2 | | 1/1997 |
| JP | 62223012 | A | * | 10/1987 |
| WO | 91/15292 | A1 | | 10/1991 |
| WO | 01/55054 | A1 | | 8/2001 |

* cited by examiner

COMPOSITION AND APPARATUS FOR TRANSFERRING HEAT TO OR FROM FLUIDS

DESCRIPTION

The present invention relates to an improved composition and apparatus for transferring heat to or from fluids, particularly but not exclusively for chilling or heating canned or bottled fluids.

It is desirable to be able to chill canned beverages, such as beer and soft drinks, without the need for a refrigerator. Self-chilling cans are highly convenient and environmentally friendly since the availability of such cans may reduce the use of old and poorly serviced refrigerators in less developed countries which can leak harmful substances into the atmosphere. One type of self-chilling can, marketed under the brand name "Chill Can" has been developed which is highly effective in cooling the fluid contained in the can but contains a hydrofluorocarbon refrigerant, a powerful greenhouse gas, which is released into the atmosphere.

A further chiller has been developed that uses a carbon dioxide based capsule (European Patent Publication No. 757204) having relatively low-pressure carbon dioxide gas adsorbed onto activated charcoal. The adsorption of the carbon dioxide gas onto the activated carbon causes the molecules to be brought closer together resulting in the capsule absorbing energy and heating up. The sealed capsule having the carbon dioxide trapped therein is then allowed to cool to room temperature. Opening of the capsule causes the carbon dioxide gas to escape from the surface of the activated carbon resulting in the molecules taking up energy from their surroundings to produce a cooling effect. A sealed capsule may be incorporated into a drinks can which is provided with a mechanism for breakage of the seal of the capsule when chilling of the liquid is required, thereby causing release of carbon dioxide to effect cooling of the fluid contained in the can.

The aforementioned self-cooling drinks can is relatively effective and does not result in harmful substances being released into the atmosphere. However, although the initial drop in temperature of the fluid is achieved relatively quickly, (for example, 25° C. to 12° C. in approximately 3 minutes), the final drop in temperature to reach a satisfactory drinking temperature takes a lot longer. This reduces the appeal of the self-chilling can to the consumer.

It is an object of the present invention to provide an improved composition and apparatus for effecting an increased rate of transfer of heat energy to or from a fluid thereby enabling a desired temperature of fluid to be obtained more rapidly.

Accordingly, a first aspect of the present invention provides a composition for effecting the transfer of heat to or from a liquid, the composition comprising a primary adsorbent material for adsorption of gas, a graphite material in an amount 0.01 to 80% by weight of the total composition, and a binder material.

Preferably, the primary adsorbent material is activated carbon and the gas to be adsorbed is carbon dioxide. In the context of this disclosure, "activated carbon" relates to a family of carbonaceous materials specifically activated to develop strong adsorptive properties whereby even trace quantities of liquids or gases may be adsorbed onto the carbon. Such activated carbons may be produced from a wide range of sources, for example coal, wood, nuts (such as coconut) and bones and may be derived from synthetic sources, such as polyacrylonitrile. Various methods of activation exist, such as selective oxidation with steam, carbon dioxide or other gases at elevated temperatures or chemical activation using, for example, zinc chloride or phosphoric acid.

The composition further comprises the primary adsorption material and graphite having carbon dioxide adsorbed to the surface thereof.

Any available form of graphite, natural or synthetic, may be incorporated into the composition of the present invention, for example powdered or flakes of graphite may be used. Preferably, graphite is included in an amount ranging from 10% to 50% by weight, more preferably 20% to 45% by weight, especially 40% by weight.

A binder material is included within the composition, such as polytetrafluoro-ethylene, to achieve densification of the formulation.

Preferably, the composition is provided in the form of a monolith or block. It is preferable to provide the composition in the form of a continuous, preferably cylindrical, block thereby assisting in heat transfer due to the absence of voids between the carbon particles. Mechanical manipulation of the block or monolith may be carried out, for example, by drilling holes into the block, to enhance gas transfer by increasing the surface area from which the gas can escape.

According to a second aspect of the present invention there is provided an apparatus for effecting transfer of heat to or from a fluid, the apparatus comprising a primary adsorption material for adsorption of a gas, sealing means for retaining said gas on the surface of the material and a release mechanism for breakage of the seal, characterised in that the primary adsorption material includes a graphite material in an amount 0.01% to 80% by weight and a binder material.

The apparatus may be provided with a vessel for holding the fluid, whereby breakage of the seal releases the adsorbed gas from the adsorption material thereby effecting cooling of the fluid.

Figure 2:
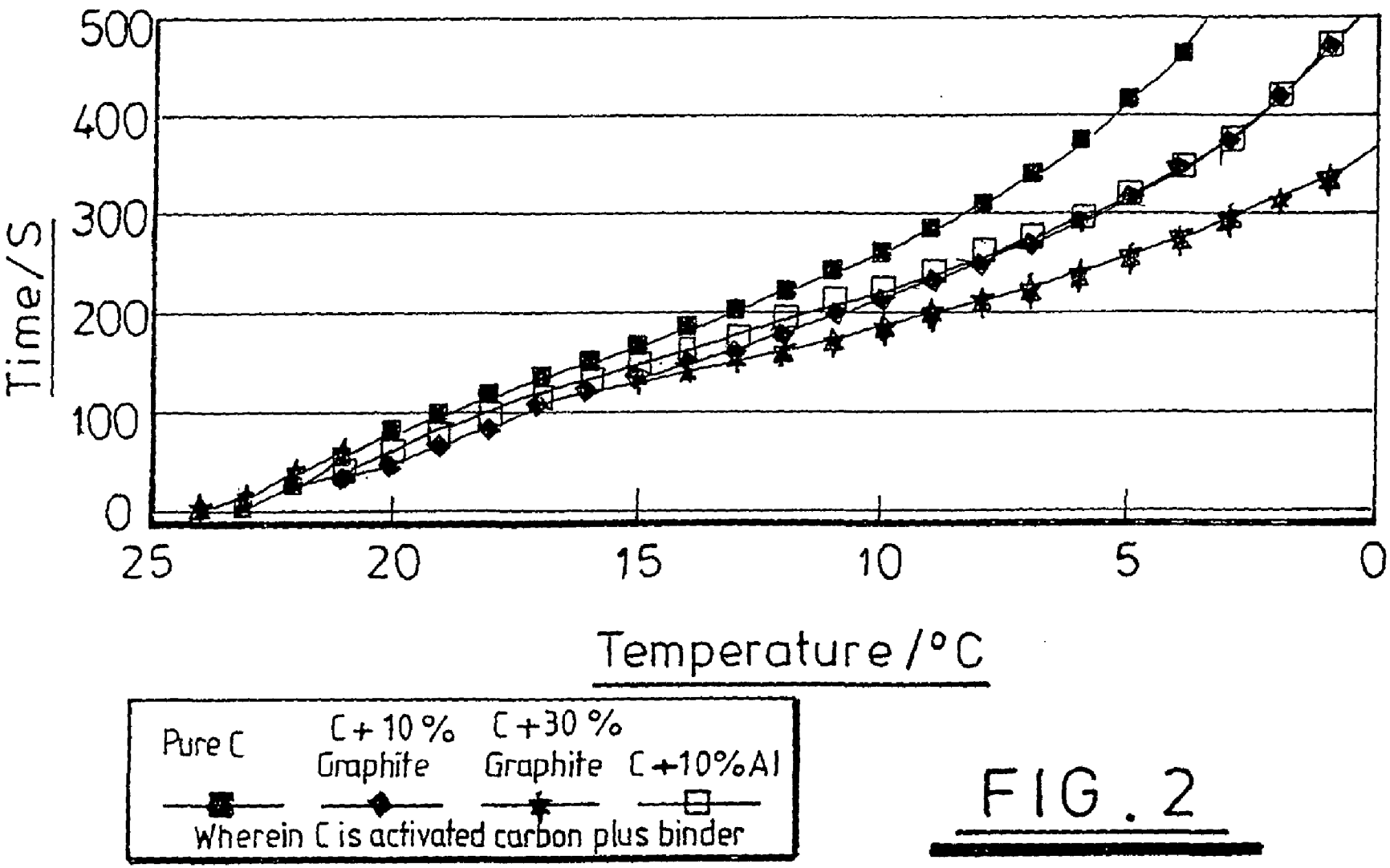
Figure 3:
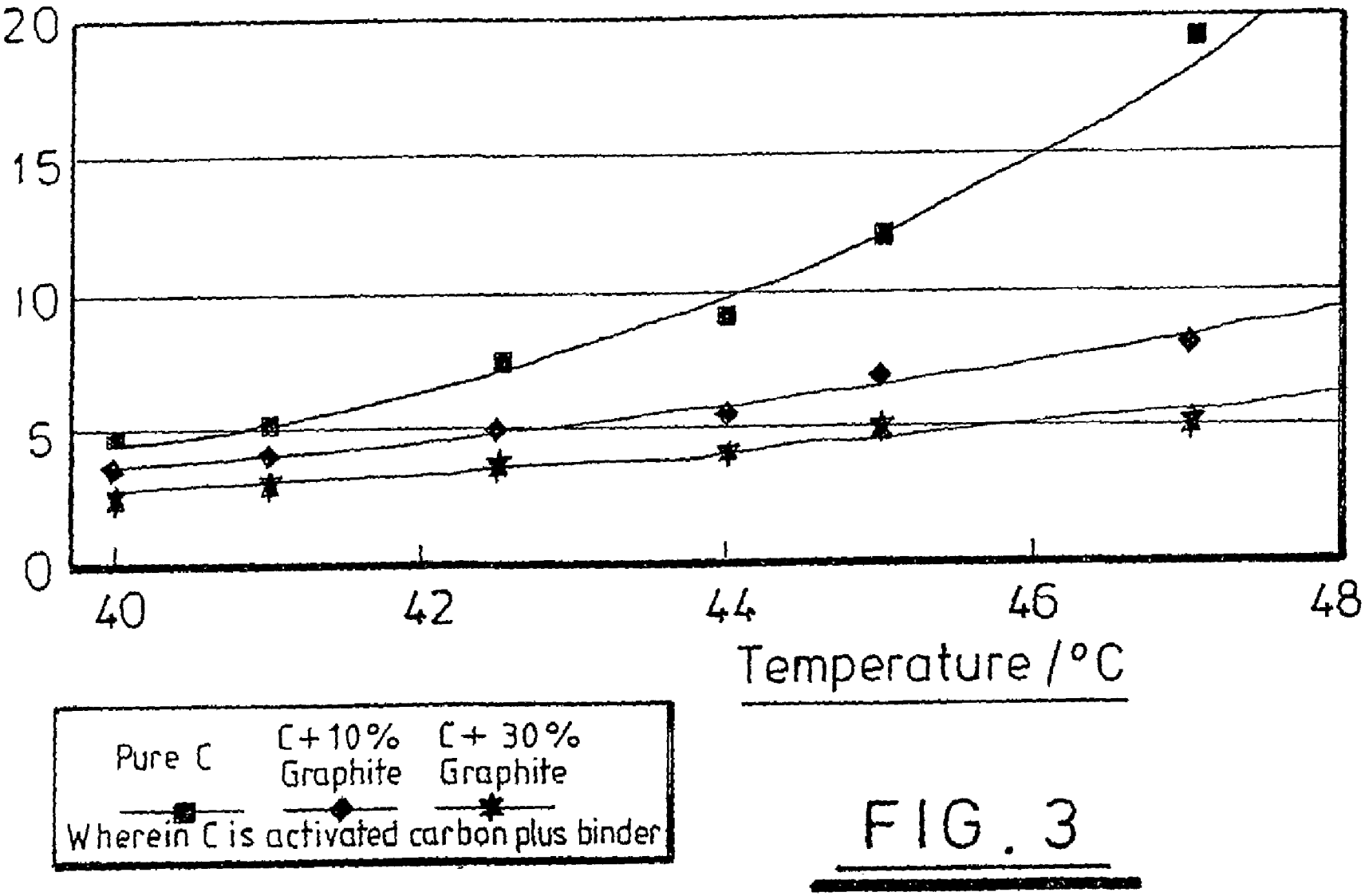

The present invention will now be further illustrated by means of the following Examples in which Example 1 investigates the cooling effect of a composition according to the present invention, Example 2 investigates the heating effect of a composition according to the present invention, Example 3 investigates the absorbed carbon dioxide uptake quantity of various compacted compositions according to the present invention, together with corresponding values for the quantity of carbon dioxide released from respective compositions on controlled venting of adsorbed carbon dioxide gas from pressure, Example 4 investigates the cooling effect resulting from controlled pressure release of adsorbed carbon dioxide gas from various compacted compositions according to the present invention and Example 5 further investigates the quantities of carbon dioxide adsorbed by an additional series of compacted compositions according to the present invention under pressurized conditions, together with corresponding values for the quantity of carbon dioxide released from respective compositions on controlled venting from pressure, and with reference to the accompanying drawings in which:

FIG. 1 is a schematic diagram of a prior art self-chilling can;

FIG. 2 is a graph comparing the cooling effect of a composition of pure activated carbon, a composition of carbon with 10% aluminium, a composition of carbon with 10% graphite and a composition of carbon with 30% graphite; and FIG. 3 is a graph comparing the heating effect of a composition of pure activated carbon, a composition of carbon with 10% graphite and a composition of carbon with 30% graphite.

Referring to FIG. 1 of the accompanying drawing, a self-chilling can 4 according to the prior art is illustrated. The necessary heat exchange unit has been eliminated for simplicity. A sealed vessel 6 is provided for holding the beverage 8 having opening means (not shown) on the top surface of the vessel to allow access to the beverage, when required. The can is provided with a block of adsorbent material 10, such as activated carbon, which is sealed within a housing 12 and has carbon dioxide adsorbed onto the surface thereof. A plug 14 is provided for retaining the carbon dioxide gas within the material and a plunger 16 is provided for breakage of the seal. In this manner, breaking the seal by means of the plunger 16 releases carbon dioxide from the adsorbent material causing the material to cool dramatically. This cooling effect enables the liquid contained in the vessel to be cooled without the requirement of a refrigerator.

It has been found that the inclusion of graphite within the adsorption material increases the rate of transfer of heat from the material to its surroundings by a surprising and unexpected amount.

EXAMPLE 1

The cooling effect of the compacted composition of the present invention was investigated by cooling a steel block to −55° C. using hydrated calcium chloride and ice and monitoring the time taken for the composition in contact with the block to decrease in temperature (measured by means of a thermocouple in contact with the compacted composition surface). The cooling effect was monitored in relation to compositions containing 10% and 30% by weight of graphite. Further similar investigations were carried out in relation to compacted activated carbon and a compacted carbon formulation containing 10% by weight of aluminium powder. Table 1 below and FIG. 2 illustrate the results of the experiment. (Percentage additions of graphite, PTFE and aluminium relate to formulations based upon additions to 100 parts activated carbon e.g., 100 g activated carbon plus 30 g graphite plus 10 g PTFE).

TABLE 1

| Temperature/° C. | COMPOSITION | | | |
|---|---|---|---|---|
| | Activated Carbon | Carbon + 10% Aluminium | Carbon + 10% Graphite | Carbon + 30% Graphite |
| | Time taken to reach Temperature/seconds | | | |
| 23 | — | — | — | 9 |
| 22 | 25 | — | 25 | 37 |
| 21 | 55 | 40 | 33 | 59 |
| 20 | 80 | 60 | 45 | 70 |
| 19 | 97 | 80 | 66 | 85 |
| 18 | 115 | 100 | 85 | 95 |
| 17 | 130 | 115 | 100 | 106 |
| 16 | 147 | 127 | 120 | 115 |
| 15 | 165 | 142 | 130 | 127 |
| 14 | 182 | 155 | 145 | 135 |
| 13 | 200 | 171 | 160 | 149 |
| 12 | 219 | 186 | 177 | 158 |
| 11 | 240 | 199 | 192 | 169 |
| 10 | 260 | 213 | 210 | 183 |
| 9 | 282 | 231 | 227 | 195 |
| 8 | 308 | 251 | 248 | 208 |
| 7 | 338 | 267 | 268 | 221 |
| 6 | 372 | 287 | 290 | 237 |
| 5 | 415 | 315 | 315 | 254 |

TABLE 1-continued

| Temperature/° C. | COMPOSITION | | | |
|---|---|---|---|---|
| | Activated Carbon | Carbon + 10% Aluminium | Carbon + 10% Graphite | Carbon + 30% Graphite |
| 4 | 465 | 340 | 345 | 270 |
| 3 | 525 | 374 | 376 | 290 |
| 2 | — | 407 | 417 | 310 |
| 1 | — | 462 | 470 | 335 |
| 0 | — | 525 | — | 364 |

It is clear from the results of the investigation that a composition having 10% graphite has a similar cooling effect as a composition containing 10% aluminium with activated carbon. This is surprising in that aluminium is known to have a higher thermal conductivity than graphite and therefore it would be expected that the composition containing aluminium would have shown a more rapid cooling effect than the compacted composition containing an equivalent graphite admixture. It is desirable to use a composition containing graphite rather than one containing an aluminium powder to provide a self-chilling drinks can insert because graphite is more compatible with the activated carbon as well as being a less expensive material. The inclusion of 30% graphite enabled the compacted composition to reach the desired temperature (generally a temperature of less than 10° C. would be considered suitably chilled for a beverage) more quickly than any of the other tested compositions. This is advantageous as it reduces the total length of time taken to obtain a satisfactory drop in temperature of a beverage contained within a can.

EXAMPLE 2

The heating effect of the composition of the present invention was investigated by heating a block to 79° C. and then monitoring the time taken for the compacted composition in contact with the steel block to increase in temperature (measured by means of a probe thermocouple in contact with the compacted composition surface). The heating effect was monitored in relation to compositions containing 0%, 10% and 30% by weight of graphite. FIG. 3 of the accompanying drawings is a graph of the results of the experiment illustrating that a composition containing carbon with 10% graphite increased in temperature faster than one containing pure carbon alone. Again, inclusion of more graphite (30%) in the compacted composition increased the speed of the heating effect.

Examples 1 and 2 demonstrate that compositions according to the present invention increase the rate of chilling of a fluid over that of the prior art. The process for cooling the fluid involves a physical reaction wherein adsorbed carbon dioxide gas is released from the activated carbon and graphite mixture. Preferably, no more than 50% of the composition is comprised of graphite since this will detrimentally reduce the adsorption capacity of the composition.

EXAMPLE 3

An investigation was undertaken into the quantity of carbon dioxide gas adsorbed under pressurised conditions by various compacted compositions according to the present invention, together with determinations of the amount of carbon dioxide gas released from respective compositions under conditions of venting of gas pressure.

An experimental test rig comprising a test can of 209 $cm^3$ volume with associated connections was filled to capacity with a compacted carbon composition by application of a suitably sized ram compression device operating up to 2.75 kN $cm^{-2}$ applied force (2 tons per square inch). The weight of the compacted composition was recorded. A supply of compressed carbon dioxide gas was connected to the experimental test can and gas slowly introduced at ambient temperature. It was noted that the test can and contents would increase in temperature due to the adsorption exotherm. The test can rig and contents were transferred to a cold bath at 0° C. and the compressed carbon dioxide connection was maintained at a pressure of 11 bar for 60 minutes until full gas uptake was achieved. The test can contents were reweighed and carbon dioxide uptake determined. The pressurised test can was left to attain ambient temperature and the test can rig was then vented to atmosphere by means of operating the plunger device to open the plug seal at the can base. After 20 minutes the vented can was reweighed to determine the amount of carbon dioxide released. Test cans were left to attain ambient temperature and reweighed after approximately 16 hours following venting of gas. Compacted compositions tested included formulations with 0%, 10% and 30% inclusions of graphite to a selected grade of granular activated carbon with PTFE binder. For comparison purposes a test was also completed using the granular activated carbon without binder or graphite addition. Table 2 below illustrates the results of the experiments.

TABLE 2

| Sample Reference | Graphite Addition % | Binder Addition % | Compact Density g $cm^{-3}$ | $CO_2$ Uptake 10 mins ambient | Full $CO_2$ Uptake 0° C. 11 bar | $CO_2$ Released 20 mins after venting | $CO_2$ Released 16 hours |
|---|---|---|---|---|---|---|---|
| Carbon Control | NIL | NIL | 0.56 | 27.6 g | 62.5 g | 39.3 g | 50.1 g |
| LM 254 | NIL | 10 | 0.61 | 28.4 g | 62.5 g | 44.3 g | 59.3 g |
| LM 255 | 10 | 11 | 0.64 | 27.3 g | 62.0 g | 41.1 g* | 55.8 g |
| LM 256 | 30 | 12 | 0.71 | 27.3 g | 59.7 g | 42.5 g | 57.7 g |

Note:
Ambient temperature 19.5° C.
*calculated quantity

The test values indicate that each compacted composition according to the present invention provide an increased compressed density compared to the control carbon. Carbon dioxide uptake values for the compositions were broadly similar to the control carbon and were not reduced pro-rata with graphite additions. However, quantities of carbon dioxide released by the compacted compositions on venting for 20 minutes were favourably greater than with the control carbon, indicating that carbon dioxide was released at a slightly faster rate and that the compositions tested were less retentive. All observations and indications regarding the compacted compositions according to the invention are perceived as a major benefit for use in a chill-can application.

EXAMPLE 4

During the course of a series of additional experiments as detailed in Example 3 above, an investigation was undertaken to determine the cooling effect resulting from release of the carbon dioxide gas from the pressurised test can and contents. Particular attention was made to the effect of admixed graphite and binder addition on minimum temperature obtained to the time elapsed after venting to reach the respective minimum temperature and also to the recorded minimum temperature differential (i.e. the difference in achieved minimum temperatures between thermocouples situated at upper and lower positions on a cooling can test rig). Additionally, reference was made to variance in measured values of thermal conductivity as determined for compacted compositions according to the present invention.

Following each venting of the carbon dioxide the surface temperature was measured at two points by means of probe thermocouples in contact with the test can surface situated at the top and bottom of the can. Using a data acquisition system to monitor and capture the cooling characteristics up to 3000 data points were collected for each temperature channel for 20 minutes.

A summary of the experimental results is shown in Table 3 below, including the minimum temperature attained by the test can (representing an average of top and bottom minimum temperatures) and the time taken from gas venting to reach each respective minimum temperature. A value of cooling differential is included in Table 3 which represents the difference in achieved minimum temperature for the thermocouples at the top and bottom of the can.

TABLE 3

| Sample Ref. | Graphite % | Binder % | Thermal Conductivity W/mK | $T^0_{min}$ (avg.) ° C. | Cooling Differential ° C. | Time to Reach $T^0_{min}$ minutes |
|---|---|---|---|---|---|---|
| Carbon | 0 | 0 | — | −12.3 | 5.4 | 2.21 |
| LM 254 | 0 | 10 | 0.274 | −13.0 | 3.2 | 2.55 |
| LM 255 | 10 | 11 | 0.301 | −14.4 | 2.6 | 2.30 |
| LM 256 | 30 | 13 | 0.447 | −15.0 | 2.5 | 2.30 |

Note:
Experimental start temperature 10° C.

For the purpose of additional comparison, examples of each compacted composition were seperately prepared and independently investigated for their effective Thermal Conductivity property. The testing employed was an absolute procedure for determination of steady state thermal conductivity, measured using a modified guarded hot plate method. Determinations of effective thermal conductivity were based upon measurements of temperature gradient produced through a compacted carbon compaction by application of a known axial heat flux under steady state conditions.

The effect of adding graphite to the activated carbon composition was found to increase the cooling effect, $T^{\circ}_{min}$, and to also shorten the time taken to reach the minimum temperature. The greatest effect was observed with the compacted composition containing 30% addition of graphite (LM 256) which gave the lowest temperature minimum without any increase in time taken to reach this minimum relative to the 10% graphite composition, despite the lower temperature attained. Minimum temperatures of −15° C. were achieved which represent a significant overall reduction of 25° C. from a start temperature of 10° C. for test can and contents. Thermal conductivity and cooling differential properties were directly related to the amount of graphite included in the compacted composition. An increase in graphite addition produced a corresponding increase in thermal conductivity and a reduction in temperature differential between top and bottom of the test can. It was also noted that inclusion of a PTFE binder alone in the carbon composition (LM 254) also increased the cooling effect, showing both a lower minimum temperature and a reduced temperature differential compared to activated carbon alone.

EXAMPLE 5

A further investigation was conducted for an additional series of compacted compositions according to the present invention to determine the quantity of carbon dioxide absorbed and released and to investigate the cooling effect from controlled pressure release of adsorbed carbon dioxide from the various compacted compositions containing respectively 25%, 30%, 40%, 60% and 80% inclusions of graphite to the same selected grade of granular activated carbon used in Examples 3 and 4 above, together with PTFE binder.

The series of experiments were conducted in a manner identical to that previously described in respect of Examples 3 and 4. Attention was made to the effects of graphite and binder addition on compacted density, minimum temperature achieved, the time elapsed after pressure venting to achieve a respective minimum temperature and the recorded minimum temperature differential (as defined above).

The results of the experimental test results are given in Table 4 below:—

TABLE 4

| Reference | LM 003 | LM 004 | LM 005 | LM 007 | LM 008 |
|---|---|---|---|---|---|
| Parts carbon | 100 | 100 | 100 | 100 | 100 |
| Parts graphite | 25 | 30 | 40 | 60 | 80 |
| Parts binder | 12.5 | 13 | 14 | 16 | 18 |
| Compacted Carbon Wt. 2 tons/in$^2$ | 139.5 g | 144.0 g | 158.8 g | 171.4 g | 181.8 g |
| Compacted Density g cm$^{-3}$ | 0.667 | 0.690 | 0.76 | 0.82 | 0.87 |

TABLE 4-continued

| Reference | LM 003 | LM 004 | LM 005 | LM 007 | LM 008 |
|---|---|---|---|---|---|
| $CO_2$ Uptake 10 minutes ambient | 27.2 g | 26.7 g | 29.0 g | 26.4 g | 28.3 g |
| Full $CO_2$ Uptake 0° C.; 12 bar | 54.1 g | 53.2 g | 52.2 g | 51.9 g | 51.6 g |
| $CO_2$ released 20 minutes | 38.2 g | 38.0 g | 39.9 g | 39.8 g | 40.3 g |
| Minimum Temp. $T^0_{min}$ (avg.) | −14.7 | −14.9 | −15.9 | −12.9 | −13.9 |
| Cooling Differential ° C. | 4.1 | 4.6 | 4.1 | 6.1 | 4.1 |
| Time to reach $T^0_{min}$ minutes | 1.90 | 2.05 | 2.05 | 2.44 | 2.20 |

The results indicated that each of the compacted compositions according to the present invention gave an increased compressed density as the corresponding graphite addition increased. Carbon dioxide uptake values for the compacted compositions, at 0° C. & 12 bar pressure, reduced slightly as the corresponding graphite addition increased. However, the weight of carbon dioxide released by the compacted compositions on venting for 20 minutes remained fairly constant throughout, independent of graphite proportion. The greatest cooling effect, from this series and the previous series of compacted compositions tested in Example 4, was observed with the composition containing 40% addition of graphite (i.e. LM 005). LM 005 compacted composition gave the lowest minimum temperature of −15.9° C. which represented a significant overall cooling effect.

Formulations which contained either more or less proportion of graphite did produce an appreciable cooling effect, however they did not quite achieve the extent of cooling as the 40% graphite composition LM 005. The time for compacted composition LM 005 to achieve minimum temperature was 2.05 minutes from $CO_2$ venting. This represented a substantial increase in the rate of cooling compared to the rate produced by a compacted control carbon with no additions of graphite or binder, detailed in Example 4: Table 3 i.e. LM 005 compacted formulation produced a further 3.6° C. reduction in minimum temperature which was achieved in 0.16 minutes less time. Cooling Differential property for the compacted composition LM 005 was 4.1° C. which was fairly typical for the additional series of compacted formulations tested (i.e. difference in achieved minimum temperature for thermocouples placed at the top and bottom of the test can during $CO_2$ release from pressure).

The invention claimed is:

1. A pressurized composition for effecting the transfer of heat to or from a fluid, the composition comprising a primary adsorbent material for adsorption and release of gas, a graphite material in an amount of 0.01 to 80% by weight and a binder material, wherein said materials are mixed or admixed.

2. A composition as claimed in claim 1, wherein the primary adsorbent material is activated carbon and the gas to be adsorbed is carbon dioxide.

3. A composition as claimed in claim 1, wherein the primary adsorbent material has carbon dioxide adsorbed to the surface thereof.

4. A composition as claimed in claim 1 wherein natural or synthetic graphite is used.

5. A composition as claimed in claim 1 wherein graphite is included in an amount from 10% to 50% by weight.

6. A composition as claimed in claim 5 wherein the graphite is included in an amount of 20% to 40% by weight.

7. A composition as claimed in claim 6 wherein the graphite is included in an amount of 40% by weight.

8. A composition as claimed in claim 7 wherein the binder material is polytetrafluoroethylene.

9. A composition as claimed in claim 8, wherein the composition is provided in the form of a monolith.

10. A composition as claimed in claim 9 wherein the composition is in the form of a cylindrical monolith.

11. A composition as claimed in claim 10 wherein holes are inserted in the monolith.

12. A composition as claimed in claim 8 wherein the composition is in the form of a continuous block.

13. A composition as claimed in claim 12 wherein the composition is mechanically manipulated to increase gas transfer therefrom.

14. A composition as claimed in claim 6 wherein the binder material is polytetrafluoro-ethylene.

15. A composition as claimed in claim 14, wherein the composition is provided in the form of a monolith.

16. A composition as claimed in claim 15 wherein the composition is in the form of a cylindrical monolith.

17. A composition as claimed in claim 16 wherein the composition is mechanically manipulated to increase gas transfer therefrom.

18. A composition as claimed in claim 14 wherein the composition is in the form of a continuous block.

19. A composition as claimed in claim 5 wherein the binder material is polytetrafluoro-ethylene.

20. A composition as claimed in claim 19, wherein the composition is provided in the form of a monolith.

21. A composition as claimed in claim 20 wherein the composition is in the form of a cylindrical monolith.

22. A composition as claimed in claim 21 wherein the composition is mechanically manipulated to increase gas transfer therefrom.

23. A composition as claimed in claim 22 wherein holes are inserted in the cylindrical monolith.

24. A composition as claimed in claim 23 wherein holes are inserted in the cylindrical monolith.

25. A composition as claimed in claim 19 wherein the composition is in the form of a continuous block.

26. A composition as claimed in claim 1 wherein the binder material is polytetrafluoroethylene.

27. A composition as claimed in claim 1, wherein the composition is provided in the form of a monolith.

28. A composition as claimed in claim 27 wherein the composition is in the form of a cylindrical monolith.

29. A composition as claimed in claim 27 wherein the composition is mechanically manipulated to increase gas transfer from the monolith.

30. A composition as claimed in claim 29 wherein holes are inserted in the monolith.

31. A composition as claimed in claim 1 wherein the composition is in the form of a continuous block.

32. A composition as claimed in claim 31 wherein holes are inserted in the block.

33. An apparatus for effecting heat transfer to or from a fluid, the apparatus comprising a pressurized primary adsorption material for adsorption and release of a gas, sealing means for retaining said gas on the surface of the material and a release mechanism for breakage of the seal, characterized in that the primary adsorption material includes a graphite material in an amount of 0.01 to 80% by weight and a binder material.

34. An apparatus as claimed in claim 33 further comprising a vessel for holding the fluid, whereby breakage of the seal releases the adsorbed gas from the adsorption material thereby effecting cooling of the fluid in the vessel.

35. A composition for effecting the transfer of heat to or from fluid, the composition comprising a primary adsorbent material, a graphite material in an amount of 0.01 to 80% weight, a binder material, and a gas reversibly sorbed to a surface of said absorbent material.

36. A composition as claimed in claim 35 wherein the primary adsorbent material is activated carbon.

37. A composition as claimed in claim 35 wherein the reversibly sorbed gas is carbon dioxide.

38. A composition as claimed in claim 35 wherein natural or synthetic graphite is used.

39. A composition as claimed in claim 35 wherein said binder material is polytetrafluoro-ethylene.

40. A composition as claimed in claim 35 wherein said composition is provided in the form of a monolith.

41. A composition as claimed in claim 40 wherein said composition is in the form of a cylindrical monolith.

42. A composition as claimed in claim 40 wherein said composition is mechanically manipulated to increase gas transfer from the monolith.

43. A composition as claimed in claim 40 wherein holes are inserted in the monolith.

44. A composition as claimed in claim 35 wherein said composition is in the form of a continuous block.

45. A composition as claimed in claim 44 wherein holes are inserted in the block.

* * * * *